US009670697B2

(12) United States Patent
Takahashi et al.

(10) Patent No.: US 9,670,697 B2
(45) Date of Patent: Jun. 6, 2017

(54) DOOR DEVICE WITH PRESSURE DIFFERENCE MITIGATING MECHANISM

(71) Applicants: BX Tetsuya Co., Ltd., Tokyo (JP); Bunka Shutter Co., Ltd., Tokyo (JP)

(72) Inventors: Shoji Takahashi, Tokyo (JP); Masanari Tetsuya, Tokyo (JP); Tetsuya Imabayashi, Tokyo (JP)

(73) Assignees: BX TETSUYA CO., LTD., Bunkyo-ku, Tokyo; BUNKA SHUTTER CO., LTD., Bunkyo-ku, Tokyo ( * ) Notice: Subject to any disclaimer, the term of this patent is extended or adjusted under 35 U.S.C. 154(b) by 82 days.

(21) Appl. No.: 14/377,096

(22) PCT Filed: Feb. 7, 2013

(86) PCT No.: PCT/JP2013/053606
§ 371 (c)(1),
(2) Date: Aug. 6, 2014

(87) PCT Pub. No.: WO2013/118922
PCT Pub. Date: Aug. 15, 2013

(65) Prior Publication Data

US 2015/0000198 A1 Jan. 1, 2015

(30) Foreign Application Priority Data

Feb. 10, 2012 (JP) ..... 2012-26827
Feb. 6, 2013 (JP) ..... 2013-21113

(51) Int. Cl.
*E05B 65/10* (2006.01)
*A62C 2/06* (2006.01)
(Continued)

(52) U.S. Cl.
CPC ..... *E05B 65/1026* (2013.01); *A62C 3/14* (2013.01); *E06B 3/341* (2013.01); *E06B 5/00* (2013.01);
(Continued)

(58) Field of Classification Search
CPC ..... A62C 3/14; E06B 5/00; E06B 7/20; E06B 9/00; E06B 3/341; E06B 5/12; E06B 5/16; F24F 11/00
(Continued)

(56) References Cited

U.S. PATENT DOCUMENTS 2,748,855 A * 6/1956 Siems ..... B64C 1/1407 160/180
3,380,192 A * 4/1968 McKenna ..... E06B 5/16 49/141
(Continued)

FOREIGN PATENT DOCUMENTS

JP 50-63937 6/1975
JP 7-59869 6/1995
(Continued)

*Primary Examiner* — Justin Rephann
(74) *Attorney, Agent, or Firm* — Norton Rose Fulbright US LLP

(57) ABSTRACT

A door is formed into a folding door by dividing the door into two parts to left and right, that is, a hanging door and a door-end door pivotally supported by the hanging door, and the door-end door is used as the pressure difference mitigating mechanism, and the two doors are integrally operated in a normal time, while if a pressure difference is generated, the door-end door can be first opened in order to reduce an opening force, and the door device with a pressure difference mitigating mechanism with excellent operability is provided.

A handle position, a latch position, and a torque are adjusted for a handle for door opening/closing, a door closer, a hinge closer for rotating the door-end door with respect to the
(Continued)

hanging door, a latch A of the door-end door to a door frame, and a latch B of the door-end door to the hanging door.

7 Claims, 13 Drawing Sheets

(51) Int. Cl.

| | |
|---|---|
| ***E06B 3/34*** | (2006.01) |
| ***E06B 5/00*** | (2006.01) |
| ***E06B 7/20*** | (2006.01) |
| ***E06B 9/00*** | (2006.01) |
| ***F24F 11/00*** | (2006.01) |
| *E06B 3/70* | (2006.01) |
| *E06B 5/12* | (2006.01) |
| *E06B 3/40* | (2006.01) |

(52) U.S. Cl.
CPC ..... *E06B 7/20* (2013.01); *E06B 9/00* (2013.01); *F24F 11/00* (2013.01); *E05Y 2800/102* (2013.01); *E05Y 2900/134* (2013.01); *E06B 5/125* (2013.01); *E06B 2003/343* (2013.01); *E06B 2003/346* (2013.01); *E06B 2003/406* (2013.01); *E06B 2003/7057* (2013.01); *E06B 2007/202* (2013.01)

(58) Field of Classification Search
USPC ..... 49/163, 169, 170
See application file for complete search history.

(56) References Cited

U.S. PATENT DOCUMENTS

| | | | | |
|---|---|---|---|---|
| 4,043,079 | A * | 8/1977 | Smith | E05B 65/06 119/484 |
| 4,805,835 | A * | 2/1989 | Schaus | A62C 3/14 236/49.1 |
| 4,908,987 | A * | 3/1990 | Dickson | E06B 7/32 49/169 |
| 4,914,864 | A * | 4/1990 | Hohenfeld | E06B 5/16 49/170 |
| 6,702,231 | B2 * | 3/2004 | Ward | B64C 1/1469 244/118.5 |
| 6,745,515 | B1 * | 6/2004 | Chen | E06B 7/32 160/180 |
| 2004/0266329 | A1 * | 12/2004 | Kennedy | E21F 1/12 454/169 |
| 2009/0151264 | A1 * | 6/2009 | Boens | E06B 7/36 49/383 |
| 2015/0000198 | A1 * | 1/2015 | Takahashi | A62C 3/14 49/276 |

FOREIGN PATENT DOCUMENTS

| | | |
|---|---|---|
| JP | 7-259407 | 10/1995 |
| JP | P2008-138476 A | 6/2008 |

* cited by examiner

DOOR DEVICE WITH PRESSURE DIFFERENCE MITIGATING MECHANISM

TECHNICAL FIELD

The present invention relates to a gate device with a pressure difference mitigating mechanism such as a fire door installed in a passage in a fire control area and/or a door which might be applied with a wind pressure and/or a water pressure or the like.

BACKGROUND ART

Taking up a fire door as an example, an inside of a structure such as a building is divided into fire control areas, and in order to prevent fire from spreading throughout the structure by these fire control areas, a fire door, a fire shutter or the like is provided capable of being opened/closed in the passage or the like so as to be urged to be closed all the time in a case of fire.

Such fire doors used to be called "T e-A fire door" and "Type-B fire door", and designated fire preventive equipment/fire preventive equipment is specified to have a structure through which fire does not penetrate for 1 hour or more or 20 minutes or more in the case of usual fire. In addition, in order to be reliably closed in case of fire, only two types of structures, that is, an all-time closed type fire door which is open only when it is opened by a particular intension of a person by a door closer or the like and is closed all the time other than that and an anytime closed type fire door which is closed when fire is detected are allowed. The all-time closed type fire door is not locked even if it is opened largely unlike a general door closer but is closed without fail if the person releases the hand. It is also called "all-time closed" as abbreviation.

As described above, whether it is the all-time closed fire door or the anytime closed fire door, the fire door is closed by an urging force of urging means for preventing spread in case of fire, the door is required to be easily opened manually in order to ensure evacuation at fire and to allow firefighting activities.

On the other hand, evacuation activities are assisted safely and reliably by providing a natural smoke exhaustion facility or a mechanical forced smoke exhaustion facility and by discharging smoke filled in a room or passage at fire by the smoke exhaustion facilities. But if the mechanical smoke exhaustion facility is operated, a pressure inside the room becomes negative, and opening of the fire door needs a considerable force. Such situation hinders evacuation activities of powerless people such as elderly people, children and the like, whereby human lives are put at risk and moreover, rescue activities are interfered. Similar cases are caused by an operation of an exhaustion fan of a housing unit with high sealing degree.

In order to prevent such harmful effects, the following Patent Literature has an object to provide a fire door device which eliminates a pressure difference so as to facilitate evacuation only by an opening operation using a door knob and reliably plays a role as a fire door.

CITATION LIST

Patent Literature

Patent Literature 1: Japanese Patent Laid-Open No. 7-259407

In this Patent Literature 1, as illustrated in FIG. 5, a fire door device 1 is provided with a pressure difference mitigating mechanism 7 at an opening portion 6 provided at a fire door 5. The opening portion 6 is opened by including one side surface of the fire door 5. The pressure difference mitigating mechanism 7 is provided with a movable body 10 having a size that can be fitted in/removed from the opening portion 6, and one side surface of the movable body 10 is constituted on the same surface as the one side surface of the fire door 5.

The movable body 10 is fixed to the fire door 5 rotatably by a rotating shaft 11 installed at a position biased to the one side surface side of the fire door 5. In the movable body 10, a latch 12 for fixing the fire door 5 to a fire control area 2 and a latch 13 for fixing the movable body 10 to the fire door 5 are provided. The latches 12 and 13 are coupled with a doorknob 8 through a transmission driving mechanism and are released by a door opening operation of the door knob 8. The rotating shaft 11 is urged in a direction to close the movable body 10 all the time by an urging device 14. Reference numeral 9 in the figure is an automatic closing device.

According to the fire door device of this Patent Literature 1, the pressure difference mitigating mechanism provided at the opening portion of the door is opened by the opening operation of the door knob, and by pressing the door when the pressure difference is solved, evacuation is made possible.

Moreover, according to the pressure difference mitigating mechanism, since the movable body is rotatably fixed by the rotating shaft installed at a biased position, if the latch locking the movable body is released by the opening operation of the door knob, the movable body is opened by the pressure difference, and the pressure difference is eliminated, whereby the door can be easily opened, and evacuation can be made.

Moreover, after completion of the evacuation, the movable door returns to an original position by the urging force of the urging means and is locked by the latch.

SUMMARY OF INVENTION

Technical Problem

In the above described Patent Literature 1, the pressure difference mitigating mechanism is attached to the opening portion 6 provided on the fire door 5 and is a side-door type small door as compared with the fire door 5. When a door-knob operation is performed under a pressure difference, the latch is released, the small door is automatically opened, and the pressure difference is eliminated, but the door needs to be pushed open by a knob operation or the like again after that. This operation is an operation different from usual passage, and operability is poor. Moreover, even if the small door is left open, a situation on the other side cannot be easily checked (particularly in a vertical direction)

Moreover, in the above described Patent Literature 1, the pressure difference mitigating mechanism starts movability by rotating the door knob, and the mechanism is closed upon the end of the operation of the door knob. As a result, the movable body 10 needs to be closed when the fire door 5 is released. That is because, if the movable door 10 is to be closed after the fire door 5 which is a fire door of a main door, a difference in pressure between inside and outside acts on the movable body 10, which causes a reverse closing force by an eccentric shaft, and closing becomes difficult.

Alternatively, if the force of the urging device 14 is made strong such that the movable body 10 cannot be closed, a huge pressure is required to open the door, and difficulty of release under a pressure difference environment which is intended to be eliminated cannot be solved.

An object of the present invention is to solve nonconformity of the prior-art examples and to constitute a folding door by dividing a door into two parts to left and right, that is, a hanging door and a door-end door pivotally supported by the hanging door, and the door-end door is used as the pressure difference mitigating mechanism, in which the two doors are integrally operated in a normal time, and if a pressure difference is generated, the door-end door can be first opened in order to reduce an opening force, and a door device with a pressure difference mitigating mechanism with excellent operability is provided.

Moreover, another object of the present invention is to provide a door device with a pressure difference mechanism which can automatically close the door-end door both in the normal time and when a pressure difference is generated.

Solution to Problem

In order to achieve the above described object, an invention described in claim 1 is characterized in that a door is divided into two parts to left and right, that is, a hanging door and a door-end door pivotally supported by the hanging door;

a handle for opening/closing the door, a door closer, a hinge closer supporting/rotating the door-end door with respect to the hanging door and having a pressure in a closing direction, a latch A of the door-end door to a door frame, and a latch B of the door-end door to the hanging door are provided; and assuming that:

a door opening force required against a door closing force of the door closer (handle position): $D_H$ a door closing force required against a door opening force of the door closer (handle position): $D_{HC}$ a door opening force required against a door closing force of the hinge closer (handle position): $A_H$ a force required against a releasing force of the latch B (handle position): $LB_H$ a load acting on the entire door by an air pressure difference (acting in a closing direction) (handle position): $PA_H$ a load acting on the door-end door by the air pressure difference (acting in the closing direction) (handle position): $PB_H$, the relationship is formed as follows:

$D_H < A_H + LB_H$ (the door-end door is not rotated, and the coupled door is opened)

$PA_H + D_{HC} > PB_H + A_H + LB_H$ (door-end door is opened at pressure difference)

According to the invention described in claim 1, since the door opening force required against a door closing force of the door closer (handle position): $D_H$ is smaller than a sum of the door opening force required against a door closing force of the hinge closer (handle position): $A_H$ and the force required against a releasing force of the latch B (handle position): $LB_H$, by applying the door opening force required against the door closing force of the hinge closer in the normal time, the hanging door and the door-end door can be integrally opened.

Moreover, since a sum of the load acting on the entire door by an air pressure difference (assumed to act in a closing direction) (handle position): $PA_H$ and the door opening force required against a door closing force of the door closer (handle position): $D_H$ is larger than a sum of the load acting on the door-end door by the air pressure difference (acting in the closing direction) (handle position): $PB_H$, the door opening force required against a releasing force of the latch B (handle position): $LB_H$, and the door opening force required against the door closing force of the hinge closer (handle position): $A_H$, only the door-end door can be opened first when the pressure difference is generated.

The present invention described in claim 2 is characterized in that assuming that:

a door closing force of the door closer (latch A position): $D_S$ an input load of the latch A: $LA_A$ a door closing force(torque) of the hinge closer: $A_{ST}$ a rotating force (torque) acting on the door-end door by an air pressure difference: $PB_{ST}$ rotation resistance (torque) of the door-end door by an input load of the latch A: $LA_{ST}$, and rotation resistance (torque) of the door-end door by an input load of the latch B: $LB_{ST}$, the relationship is formed as follows:

$$D_S > LA_S$$

$$A_{ST} + PB_{ST} > LA_{ST} + LB_{ST}$$

$$A_{ST} + PB_{ST} > LA_{ST}$$

$$A_{ST} + PB_{ST} > LB_{ST}.$$

According to the present invention described in claim 2, since the door closing force of the door closer (latch A position): $D_s$ is larger than the input load $LA_S$ of the latch A, the door can be self-closed in the normal time.

When the pressure difference is generated, since a sum of the door closing force (torque) of the hinge closer: $A_{ST}$ and the rotation force (torque) acting on the door-end door by the air pressure difference (assumed to act in the closing direction: $PB_{ST}$ is larger than the rotation resistance (torque) of the door-end door by an input load of the latch A: $LA_{ST}$ and also larger than the rotation resistance (torque) of the door-end door by an input load of the latch B: $LB_{ST}$, if activations of the latch A and the latch B do not occur simultaneously, the door-end door can be self-closed.

The present invention described in claim 3 is characterized in that a door is divided into two parts to left and right, that is, a hanging door and a door-end door pivotally supported by the hanging door;

a handle for opening/closing the door, a door closer, a latch A of the door-end door to the door frame, and a latch B of the door-end door to the hanging door are provided; and assuming that:

a door opening force required against a door closing force of the door closer (handle position): $D_H$ a door closing force required against a door opening force of the door closer (handle position): $D_{HC}$ a force required against a releasing force of the latch B (handle position): $LB_H$ a load acting on the entire door by an air pressure difference (acting in a closing direction) (handle position): $PA_H$ a load acting on the door-end door by the air pressure difference (acting in the closing direction) (handle position): $PB_H$, the relationship is formed as follows:

$D_H < LB_H$ (the door-end door is not rotated, and the coupled door is opened in the normal time)

$D_S > LA_S$ (the latch A is pushed in by the closing force of the door closer)

$PA_H + D_{HC} > PB_H + LB_H$ (door-end door is opened at pressure difference)

According to the present invention described in claim 3, the handle for opening/closing the door, the door closer, the latch A of the door-end door to the door frame, and the latch B of the door-end door to the hanging door are provided but the hinge closer is not provided, and since the door opening force required against a door closing force of the door closer (handle position): $D_H$ is smaller than the force required against a releasing force of the latch B (handle position): $LB_H$, the hanging door and the door-end door can be integrally opened by applying the required door opening force against the door closing force of the hinge closer in the normal time.

Moreover, since the door closing force of the door closer (latch A position): $D_S$ is larger than the input load $LA_S$ of the latch A, the door can be self-closed in the normal time.

Moreover, since a sum of the load acting on the entire door by an air pressure difference (assumed to act in a closing direction) (handle position): $PA_H$ and the door opening force required against a door closing force of the door closer (handle position): $D_H$ is larger than a sum of the load acting on the door-end door by the air pressure difference (acting in the closing direction) (handle position): $PB_H$, and the door opening force required against a releasing force of the latch B (handle position): $LB_H$, only the door-end door can be opened first when the pressure difference is generated.

The present invention described in claim 4 is characterized in that a door is divided into two parts to left and right, that is, a hanging door and a door-end door pivotally supported by the hanging door;

a handle for opening/closing the door, a hinge closer supporting/rotating the door-end door with respect to the hanging door and having a pressure in a closing direction, a latch A of the door-end door to the door frame, and a latch B of the door-end door to the hanging door are provided; and assuming that:

a door opening force required against a door closing force of the hinge closer (handle position): $A_H$ a force required against a releasing force of the latch B (handle position): $LB_H$ a load acting on the entire door by an air pressure difference (acting in a closing direction) (handle position): $PA_H$ a load acting on the door-end door by the air pressure difference (acting in the closing direction) (handle position): $PB_H$, the relationship is formed as follows:

$PA_H + D_{HC} > PB_H LB_H + A_H$ (door-end door is opened at pressure difference)

$A_{ST} > LB_{ST}$ (so that the door-end door returns to an integral opening/closing state with the hanging door).

According to the present invention described in claim 4, the handle for opening/closing the door, the hinge closer supporting/rotating the door-end door with respect to the hanging door and having a pressure in a closing direction, the latch A of the door-end door to the door frame, and the latch B of the door-end door to the hanging door are provided but the door closer is not provided, and since the load acting on the entire door by an air pressure difference (assumed to act in a closing direction) (handle position): $PA_H$ is larger than a sum of the load acting on the door-end door by the air pressure difference (acting in the closing direction) (handle position): $PB_H$, the door opening force required against a releasing force of the latch B (handle position): $A_H$, and door opening force required against the door closing force of the hinge closer (handle position): $A_N$, only the door-end door can be opened first when the pressure difference is generated.

Moreover, since the door closing force (torque) $A_{ST}$ of the hinge closer is larger than the rotation resistance (torque) of the door-end door by an input load of the latch B: $LB_{ST}$, the door-end door can return to the integral opening/closing state with the hanging door.

The present invention described in claim 5 is characterized in that a door is divided into two parts to left and right, that is, a hanging door and a door-end door pivotally supported by the hanging door;

a handle for opening/closing the door, a latch A of the door-end door to the door frame, and a latch B of the door-end door to the hanging door are provided; and assuming that:

a force required against a releasing force of the latch B (handle position): $LB_H$ a load acting on the entire door by an air pressure difference (acting in a closing direction) (handle position): $PA_H$ a load acting on the door-end door by the air pressure difference (acting in the closing direction) (handle position): $PB_H$, the relationship is formed as follows:

$PA_H > PB_H + LB_H$ (the door-end door is opened at pressure difference).

According to the present invention described in claim 5, the door is divided into two parts to left and right, that is, the hanging door and the door-end door pivotally supported by the hanging door, and the handle for opening/closing the door, the latch A of the door-end door to the door frame, and the latch B of the door-end door to the hanging door are provided but the door closer and the hinge closer for rotating the door-end door with respect to the hanging door are not provided, and since the load acting on the entire door by an air pressure difference (assumed to act in a closing direction) (handle position): $PA_H$ is larger than a sum of the load acting on the door-end door by the air pressure difference (acting in the closing direction) (handle position): $PB_H$, and the door opening force required against a releasing force of the latch B (handle position): $LB_H$, only the door-end door can be opened first when the pressure difference is generated.

The present invention described in claim 6 is characterized in that a door is divided into two parts to left and right, that is, a hanging door and a door-end door pivotally supported by the hanging door;

a handle for opening/closing the door, a door closer, a hinge closer for rotating the door-end door with respect to the hanging door, a latch A of the door-end door to the door frame, and a latch B of the door-end door to the hanging door are provided; and assuming that:

a door opening force required against a door closing force of the door closer (handle position): $D_H$ a door opening force required against a door closing force of the hinge closer (handle position): $A_H$ a force required against a releasing force of the latch B (handle position): $LB_H$ a door closing force of the door closer (latch A position): $D_S$ an input load of the latch A: $LA_S$ a load acting on the entire door by an air pressure difference (acting in a closing direction) (handle position): $PA_H$ a load acting on the door-end door by the air pressure difference (acting in the closing direction) (handle position): $PB_H$ a door closing force (torque) of the hinge closer: $A_{ST}$ a rotating force (torque) acting on the door-end door by an air pressure difference (assumed to act in the closing direction): $PB_{ST}$ rotation resistance (torque) of the door-end door by an input load of the latch A: $LA_{ST}$, and rotation resistance (torque) of the door-end door by an input load of the latch B: $LB_{ST}$, the relationship is formed as follows:

$D_H < A_H + LB_H$ (the door-end door is not rotated, and the coupled door is opened)

$D_S > LA_S$ (the latch A is pushed in by the closing force of the door closer)

$PA_H + D_{HC} > PB_H + A_H + LB_H$ (door-end door is opened at pressure difference)

$A_{ST} + PB_{ST} > LA_{ST} + LB_{ST}$ (door-end door is closed with the entire door at pressure difference)

$A_{ST} + PB_{ST} > LA_{ST}$ (door-end door is closed with the entire door at pressure difference)

$A_{ST} + PB_{ST} > LB_{ST}$ (door-end door itself is closed).

According to the present invention described in claim 6, since the door opening force required against a door closing force of the door closer (handle position): $D_H$ is smaller than a sum of the door opening force required against a door closing force of the hinge closer (handle position): $A_H$ and the force required against a releasing force of the latch B (handle position): $LB_H$, the hanging door and the door-end door can be integrally opened by applying the required door opening force against the door closing force of the hinge closer in the normal time.

Moreover, since the door closing force of the door closer (latch A position): $D_S$ is larger than the input load of the latch A: $LA_S$, the door can be self-closed in the normal time.

Since a sum of the load acting on the entire door by an air pressure difference (assumed to act in a closing direction) (handle position): $PA_H$ and the door opening force required against a door closing force of the door closer (handle position): $D_H$ is larger than a sum of the load acting on the door-end door by the air pressure difference (acting in the closing direction) (handle position): $PB_H$, the door opening force required against a releasing force of the latch B (handle position): $LB_H$, and the door opening force required against a door closing force of the hinge closer (handle position): $A_H$, only the door-end door can be opened first when the pressure difference is generated.

Since a sum of the door closing force (torque) of the hinge closer: $A_{ST}$ and the rotating force (torque) acting on the door-end door by an air pressure difference (assumed to act in the closing direction): $PB_{ST}$ is larger than a sum of the rotation resistance (torque) of the door-end door by an input load of the latch A: $LA_{ST}$, and the rotation resistance (torque) of the door-end door by an input load of the latch B: $LB_{ST}$, when the latch A and the latch B are operated simultaneously, the door-end door can be self-closed.

Moreover, since a sum of the door closing force (torque) of the hinge closer: $A_{ST}$ and the rotating force (torque) acting on the door-end door by an air pressure difference (assumed to act in the closing direction): $PB_{ST}$ is larger than the rotation resistance (torque) of the door-end door by an input load of the latch A: $LA_{ST}$ and also larger than the rotation resistance (torque) of the door-end door by an input load of the latch B: $LB_{ST}$, when the latch A and the latch B are not operated simultaneously, the door-end door can be self-closed.

The present invention described in claim 7 is characterized in that one side of the hanging door is made a notched opening while portions constituting upper and lower bearing portions are left, a stepped contracted portion of the door-end door is fitted in this notched opening, and this door-end door is pivotally supported by the hinge closer. Moreover, when the door is opened, a field of view is opened on the whole in a vertical direction, and safety can be checked similarly to a normal door.

According to the present invention described in claim 7, a rational configuration in which the door-end door is combined with the hanging door so as to constitute a folding door is provided, and a width of the door-end door can be freely set.

The present invention described in claim 8 is characterized in that an outer side of about a half of the door-end door is surrounded by the door frame.

According to the present invention described in claim 8, the door-end door has a size in contact with the door frame, and when the door-end door is to be opened, it can be opened with a small force by largely stepping in with a foot. Moreover, only the door-end door is to be opened in emergency, a field of view similar to that of a normal door can be obtained. Furthermore, by making the height of the door-end door equal to that of the hanging door, opening of this so as to solve the pressure difference is integrated with keeping the door open by a knob operation or the like (under the pressure difference), whereby a large opening can be ensured, and passage is made smooth. When the door is opened, the field of view is opened on the whole in the vertical direction, and safety can be checked similarly to a normal door.

The present invention described in claim 9 is characterized in that the rotating shaft of the door-end door pivotally supported by the hanging door is not made eccentric but set at a substantially center position.

According to the present invention described in claim 9, a force acting on the door-end door by the air pressure difference becomes equal in right and left with respect to the rotating shaft, and there is no concern that the magnitude of the force is different between right and left and the force acts in a disadvantageous direction as in the case of an eccentric shaft, and the door can be smoothly self-closed.

The present invention described in claim 10 is characterized in that a door stop piece is extended so as to cover a gap between the hanging door and the door-end door from the hanging door and/or the door-end door.

According to the present invention described in claim 10, by extending the door stop piece, reverse rotation of the door-end door can be prevented. Moreover, by covering the gap, looking through the gap is made difficult.

The present invention described in claim 11 is characterized in that an airtight rubber is attached to the door stop piece.

According to the present invention described in claim 11, drop of airtightness caused by a split constitution of the door can be suppressed.

The present invention described in claim 12 is characterized in that a dent is provided on the door frame side, and the airtight rubber is disposed therein so as to form the door with a semi-airtight specification.

According to the present invention described in claim 12, air is prevented from going back and force by the semi-airtight specification, whereby airtightness is improved, and sound is made difficult to leak, or smoke or the like can be prevented from moving back and forth. This is suitable for a door faced with an entrance of an office or an outside.

The present invention described in claim 13 is characterized in that corners of upper and lower rotating portions on the hanging door side is rounded, and the door-end door side is recessed so as to provide a covering.

According to the present invention described in claim 13, a linear penetration passage when the door is fully closed can be eliminated while a clearance required for a hinge structure is kept, and prevention of peeping and conditions for preventing spread of fire for a door to be approved as a fire door can be satisfied.

Advantageous Effects of Invention

As described above, in the door device with a pressure difference mitigating mechanism of the present invention, the door is divided into two parts to left and right, that is, a hanging door and a door-end door pivotally supported by the hanging door so as to have a folding-door type door, and the door-end door is made a pressure difference mitigating mechanism, the two doors can be operated integrally in the normal time, while the door-end door can be opened first in order to reduce an opening force when a pressure difference is generated, and operability thereof is excellent.

Moreover, the door-end door can be self-closed both in the normal time and when a pressure difference is generated.

DESCRIPTION OF EMBODIMENTS

Figure 1:
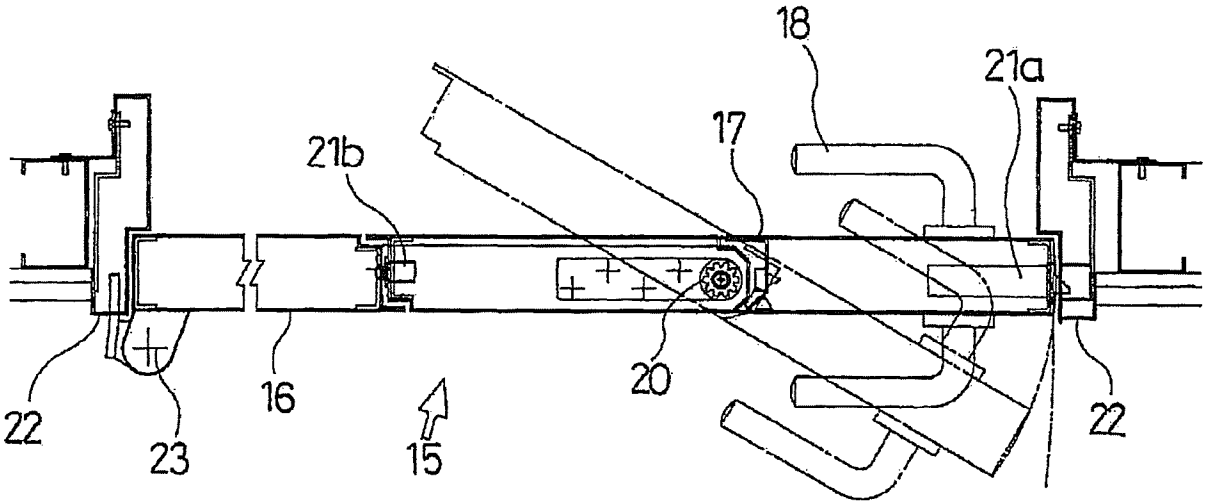
FIG. 1 is a transverse plan view illustrating an embodiment of a door device with a pressure difference mitigating mechanism of the present invention.
Figure 2:
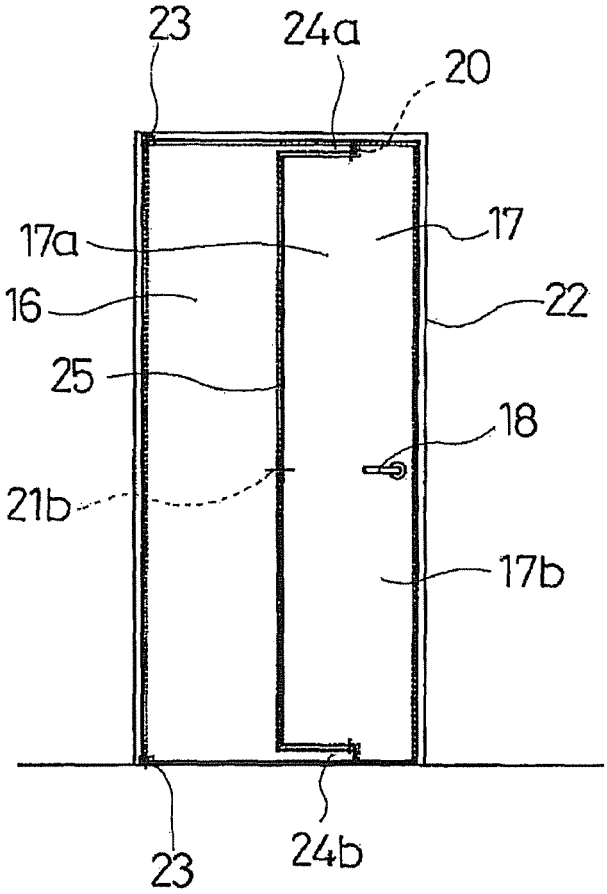
FIG. 2 is a front view illustrating the embodiment of the door device with a pressure difference mitigating mechanism of the present invention.

Embodiments of the present invention will be described below in detail by referring to the attached drawings. FIG. 1 is a transverse plan view illustrating an embodiment of a door device with a pressure difference mitigating mechanism of the present invention, and FIG. 2 is a front view of the same, in which a door 15 is afire door and is installed capable of being opened/closed on a door frame 22. Reference numeral 23 in the figure is a hinge.

The present invention is constituted as a folding-door type by dividing the door 15 into two parts to left and right, that is, a hanging door 16 and a door-end door 17 pivotally supported by the hanging door 16.

In this embodiment, one side of the hanging door 16 is made a notched opening while portions constituting upper and lower bearing portions 24*a* and 24*b* are left, a stepped contracted portion 17*a* of the door-end door 17 is fitted in this notched opening, and this door-end door 17 is pivotally supported by the hinge closer 20. The door-end door 17 becomes a balance folding door. In the one side of the hanging door 16, upper and lower side portions constituting the upper and lower bearing portions 24*a* and 24*b* are constituted as through frames (frame).

The remaining approximately half 17*b* of the door-end door 17 has the same upper and lower widths as those of the hanging door 16, and this portion is surrounded on an outer side by the door frame 22.

Figure 3:
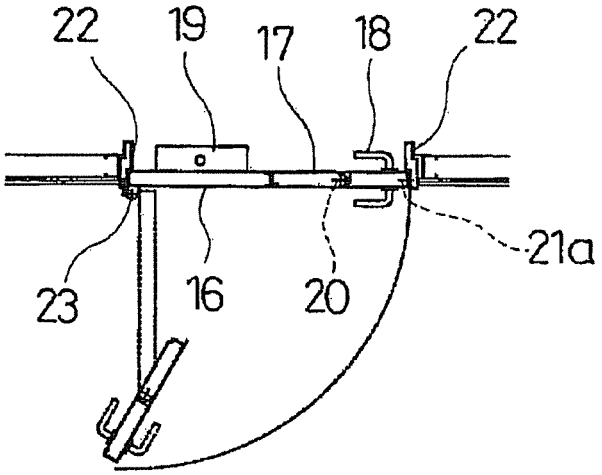
FIG. 3 is a plan view illustrating the embodiment of the door device with a pressure difference mitigating mechanism of the present invention.

A door opening/closing handle 18 is provided on the door-end door 17, and a door closer 19 is attached to the hanging door 16 (see FIG. 3).

Here, the door opening/closing handle 18 is a collective name of an operation part for door opening/closing such as a lever handle, a door knob, a grip ball, a handle and the like and includes those not in a form of a handle such as a pressing plate, for example.

On the door-end door 17, a latch A (21*a*) to the door frame 22 and a latch B (21*b*) to the hanging door 16 are provided.

For the latch A (21*a*), a normal latch using a lock claw is suitable, and for the latch B (21*b*), a roller catch (roller latch), a magnet catch type latches and the like are suitable. If the latch B is a roller catch, a balance folding door constituted by combining the door-end door with the hanging door can be held during operation, but some rattling occurs, while if the roller catch is used, there is a concern that a holding force is not sufficient. If the ball catch is used, it has a holding force but there is a concern that the ball catch is easily removed. By using the magnet catch type latches, those nonconformities are solved, and a suitable latch can be obtained.

Figure 4:
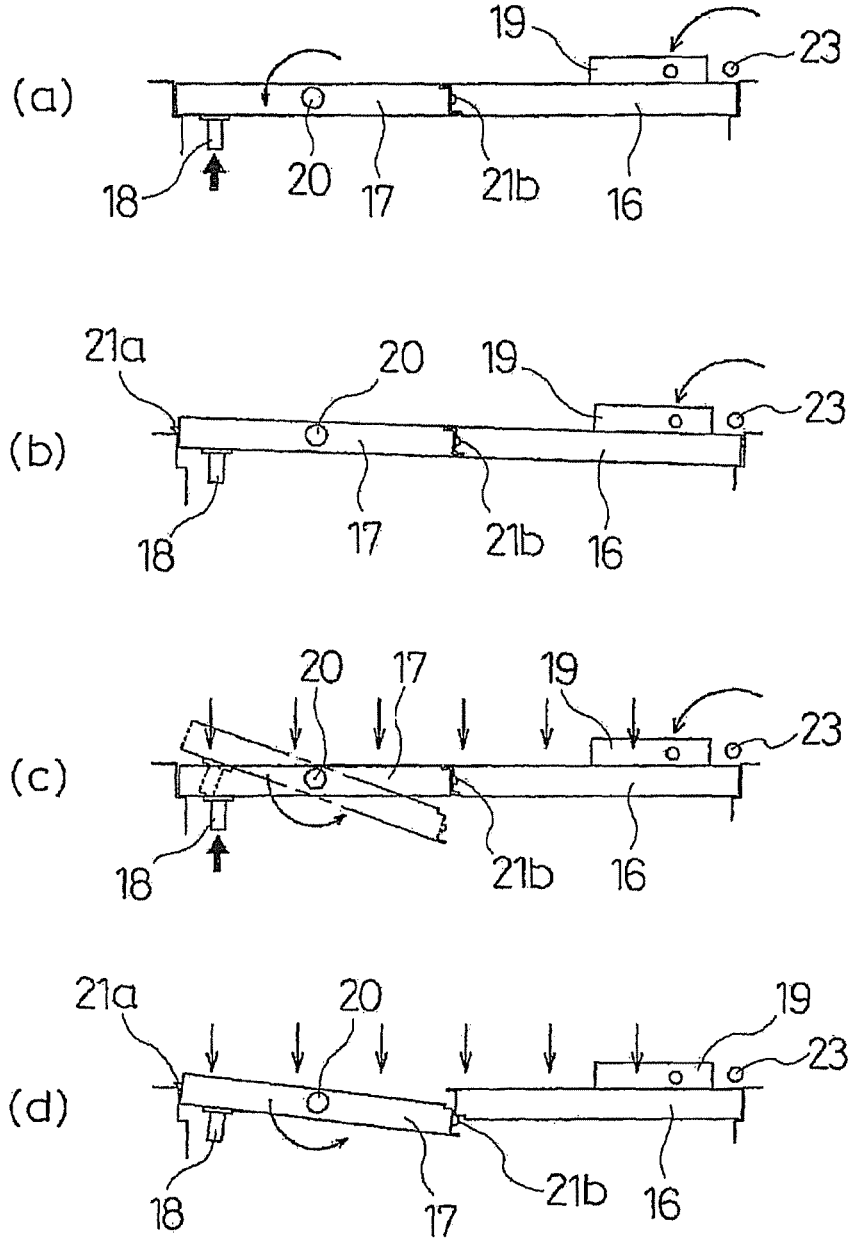
FIG. 4 are explanatory views illustrating an operation and an action of the door device with a pressure difference mitigating mechanism of the present invention.

An operation and an action of the door device with a pressure difference mitigating mechanism of the invention will be explained by referring to FIG. 4. FIGS. 4(*a*) and 4(*b*) illustrate the normal time and FIGS. 4(*c*) and 4(*d*) illustrate occurrence of a pressure difference. FIG. 4(*a*) illustrates a door during an opening operation, FIG. 4(*c*) illustrates the door during the opening operation, and FIGS. 4(*b*) and 4(*d*) illustrate a door-closed state.

In the normal time and in a door-open state, assuming that:

a door opening force required against a door closing force of the door closer (handle position): $D_H$ a door opening force required against a door closing force of the hinge closer (handle position): $A_H$ a force required against a releasing force of the latch B (handle position): $LB_H$, the following relationship is formed so that the hanging door and the door-end door are integrally opened/closed (FIG. 4(*a*)):

$$D_H<A_H+LB_H$$

In the normal time and in a door-closed state, assuming that:

a door closing force of the door closer (latch A position): $D_S$ an input load of the latch A: $LA_S$, the following relationship is formed so that the door is self-closed (FIG. 4(*b*)):

$$D_S>LA_S$$

When a pressure difference is generated and in the door-open state, assuming that:

a load acting on the entire door by an air pressure difference (assumed to act in a closing direction) (handle position): $PA_H$ a door opening force required against a door closing force of the door closer (handle position): $D_{HC}$ a load acting on the door-end door by the air pressure difference (acting in the closing direction) (handle position): $PB_H$, a door opening force required against a releasing force of the latch B (handle position): $LB_H$ a door opening force required against a door closing force of the hinge closer (handle position): $A_H$, the following relationship is formed so that only the door-end door is opened first (FIG. 4(*c*)):

$$PA_H+D_{HC}>PB_H LB_H A_H$$

When the pressure difference is generated, and in the door-closed state, assuming that:

a door closing force (torque) of the hinge closer: $A_{ST}$ a rotating force (torque) acting on the door-end door by an air pressure difference (assumed to act in a closing direction): $PB_{ST}$ rotation resistance (torque) of the door-end door by an input load of the latch A: $LA_{ST}$, and rotation resistance (torque) of the door-end door by an input load of the latch B: $LB_{ST}$, and if the latch A and the latch B are operated simultaneously, the following relationship is formed so that only the door-end door is self-closed:

$$A_{ST}+PB_{ST}>LA_{ST}+LB_{ST}$$

Similarly, if the latch A and the latch B are not operated simultaneously, the following relationship is formed so that the door-end door is self-closed:

$$A_{ST}+PB_{ST}>LA_{ST}$$

$$A_{ST}+PB_{ST}>LB_{ST}$$

By setting as above, the hanging door and the door-end door can be integrally opened/closed in the normal time, and the door can be self-closed by the door closer. When the pressure difference is generated, an air pressure difference can be mitigated by opening only the door-end door first, and the door-end door can be reliably self-closed both when the latch A and the latch B are operated simultaneously and when the latch A and the latch B are not operated simultaneously.

Figure 12:
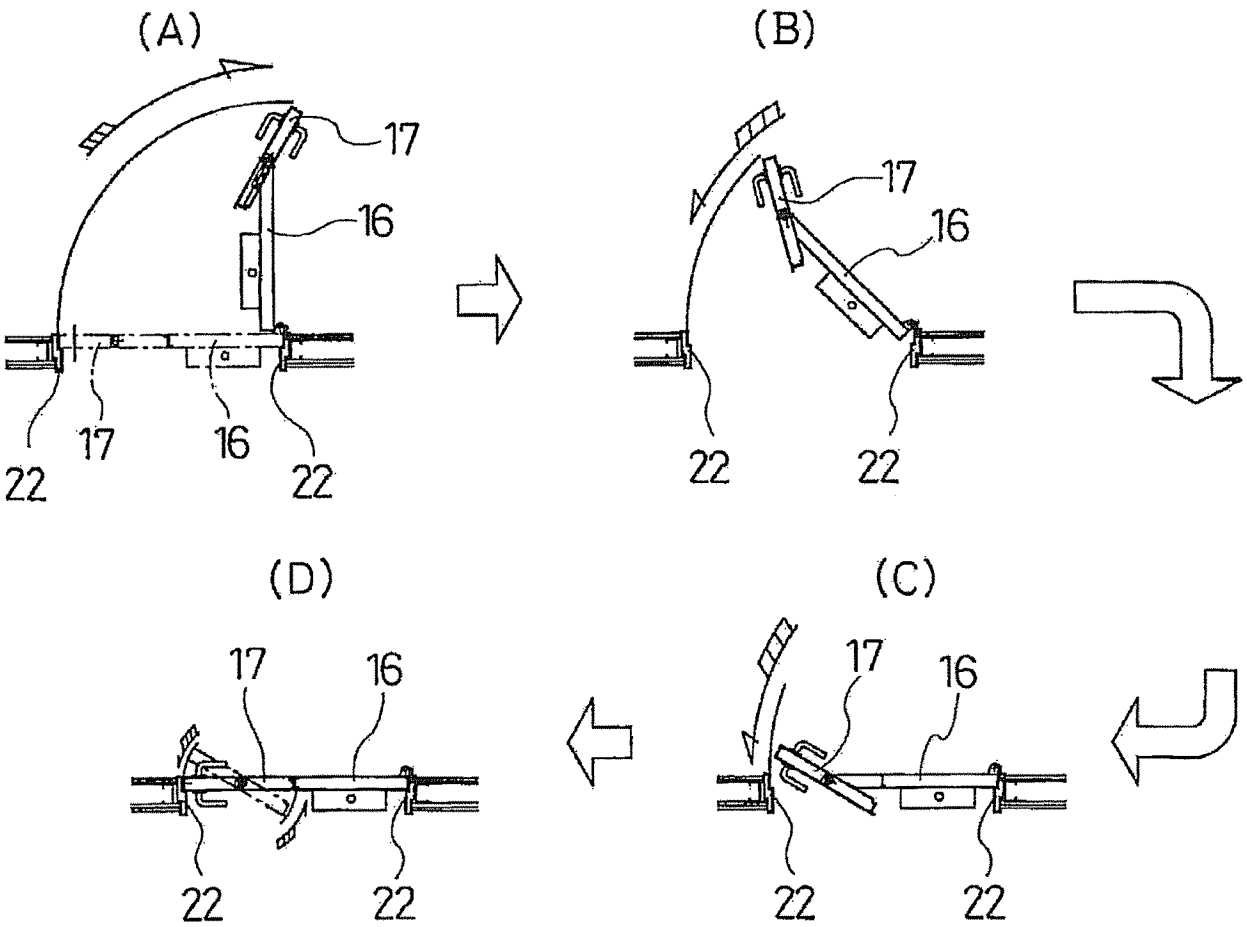
FIG. 12 is an explanatory view illustrating an operation of the door device with a pressure difference mitigating mechanism of the present invention.
Figure 13:
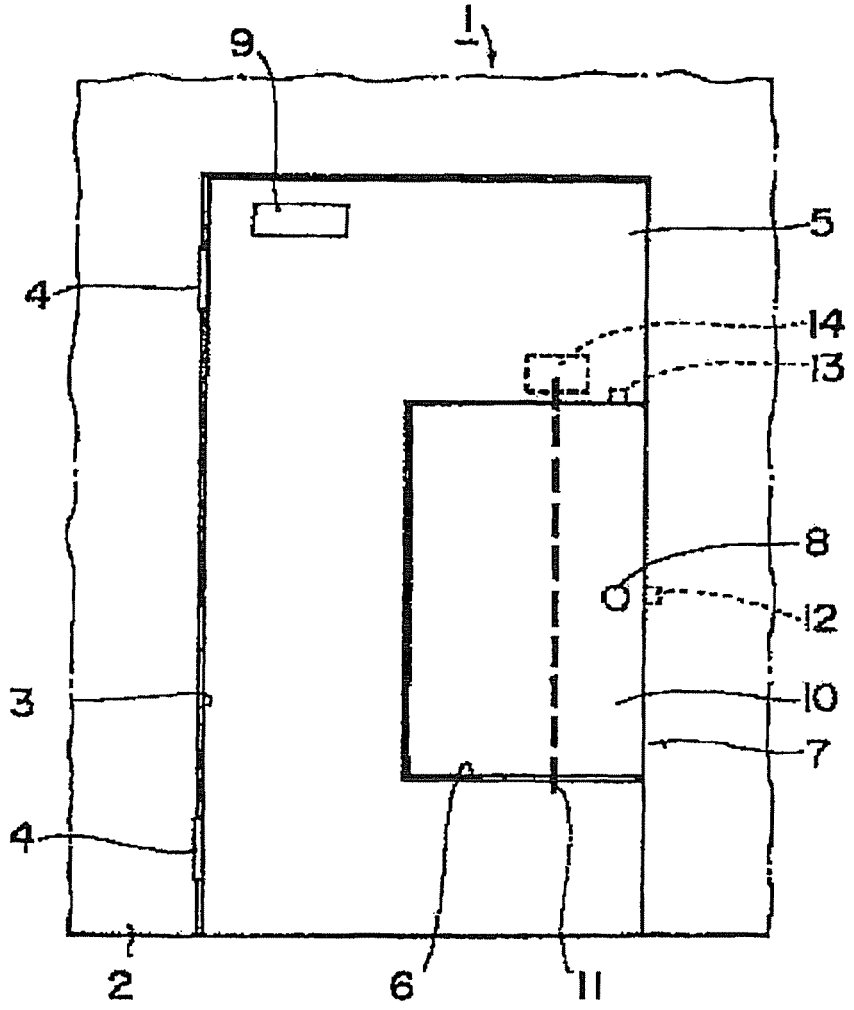
FIG. 13 is a front view illustrating a prior-art example.

Moreover, as illustrated in FIG. 12, the door-end door 17 pivotally supported by the hanging door 16 with respect to the hanging door 16 is assumed to be closed slowly after the hanging door 16 is closed. Normally, in the case of a single door, assuming that it takes approximately 40 seconds for the door to be closed from the open state by 90 degrees, in the case of the present invention, assuming that (A) illustrates a state of "0" start, (B) illustrates a state after two seconds have elapsed, (C) illustrates a state after four seconds have elapsed, and the hanging door 16 is fully closed, while the door-end door 17 which is a balance door is still open.

(D) illustrates a state after 10 seconds have elapsed, the hanging door 16 has been closed, and the door-end door 17 which is a balance door is slowly closed. By configuring as above, slow closing of the door-end door 17 can reduce a frame/door sandwiching pressure, and risk of a finger-caught accident or the like can be reduced to approximately 1/10, whereby safety is improved.

Figure 5:
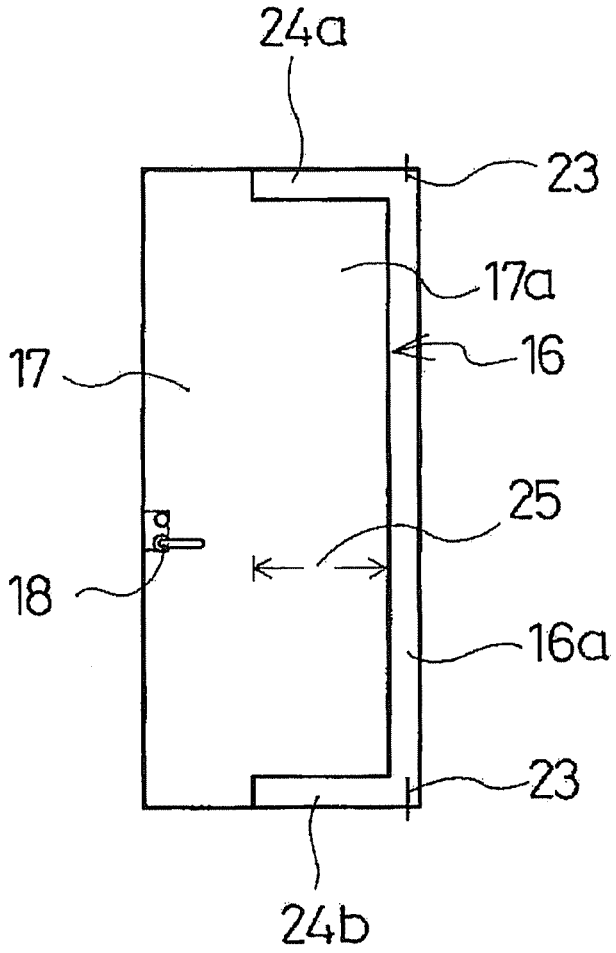
FIG. 5 is a front view illustrating a second embodiment of the door device with a pressure difference mitigating mechanism of the present invention.

FIG. 5 illustrates a second embodiment of the present invention, in which one side of the hanging door 16 is made a notched opening 25 while portions constituting the upper and lower bearing portions 24*a* and 24*b* are left, the stepped contracted portion 17*a* of the approximately half side of the door-end door 17 is fitted in this notched opening 25, but with respect to a width of the notched opening 25 made from the one side of the hanging door 16 while the portions constituting the upper and lower bearing portions 24*a* and 24*b* are left, a width of a main body portion 16*a* of the hanging door 16 juxtaposed with this opening 25 is made as small as possible.

By configuring as above, a width at the center of the door-end door 17 with respect to the hanging door 16 can be made large. The width of the door-end door 17 which is a balance folding door becomes large, and a rotation angle of the folding door can be set small.

Figure 6:
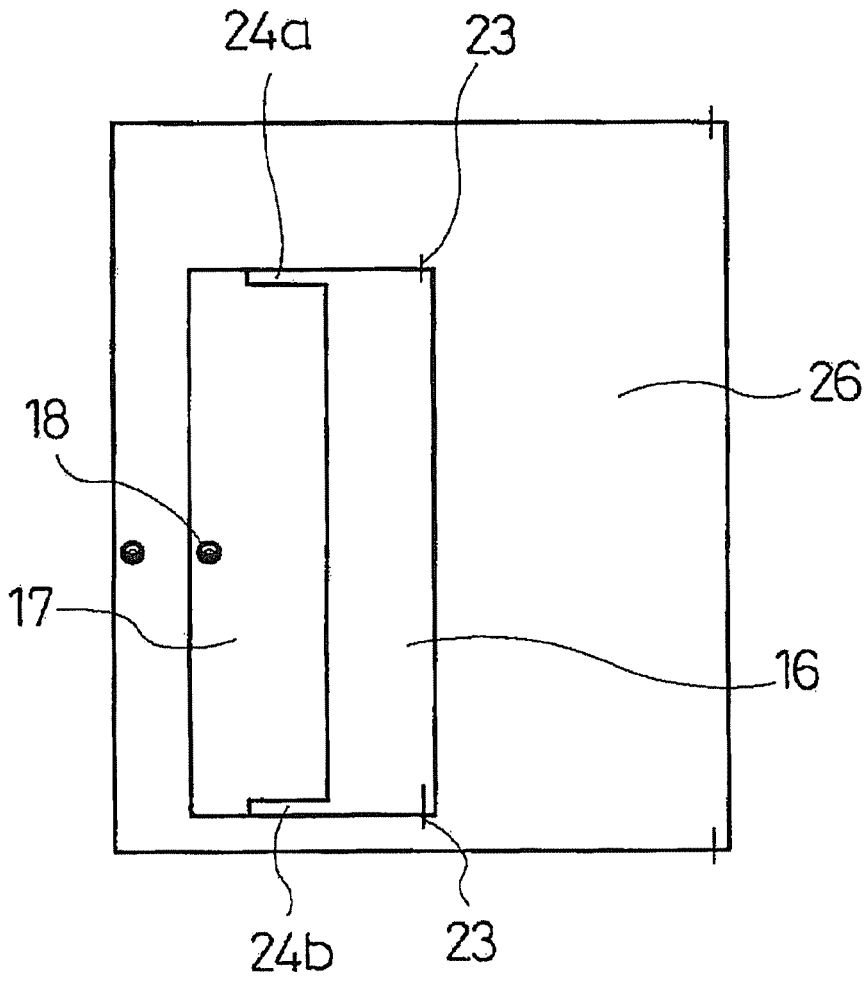
FIG. 6 is a front view illustrating a third embodiment of the door device with a pressure difference mitigating mechanism of the present invention.

FIG. 6 illustrates a third embodiment of the present invention, and a door device with a pressure difference mitigating mechanism of the present invention in which the door 15 is divided into two parts to left and right, that is, the hanging door 16 and the door-end door 17 pivotally supported by the hanging door 16 is formed as a side door to an all-time open fire door 26.

A spot is generated where opening/closing of door is made difficult upon receipt of a pressure in a state in which a smoke evacuator is operated even in the all-time open fire door, but even in such a case, the difficulty in opening/closing can be solved by applying the present invention to the side door portion.

Figure 7:
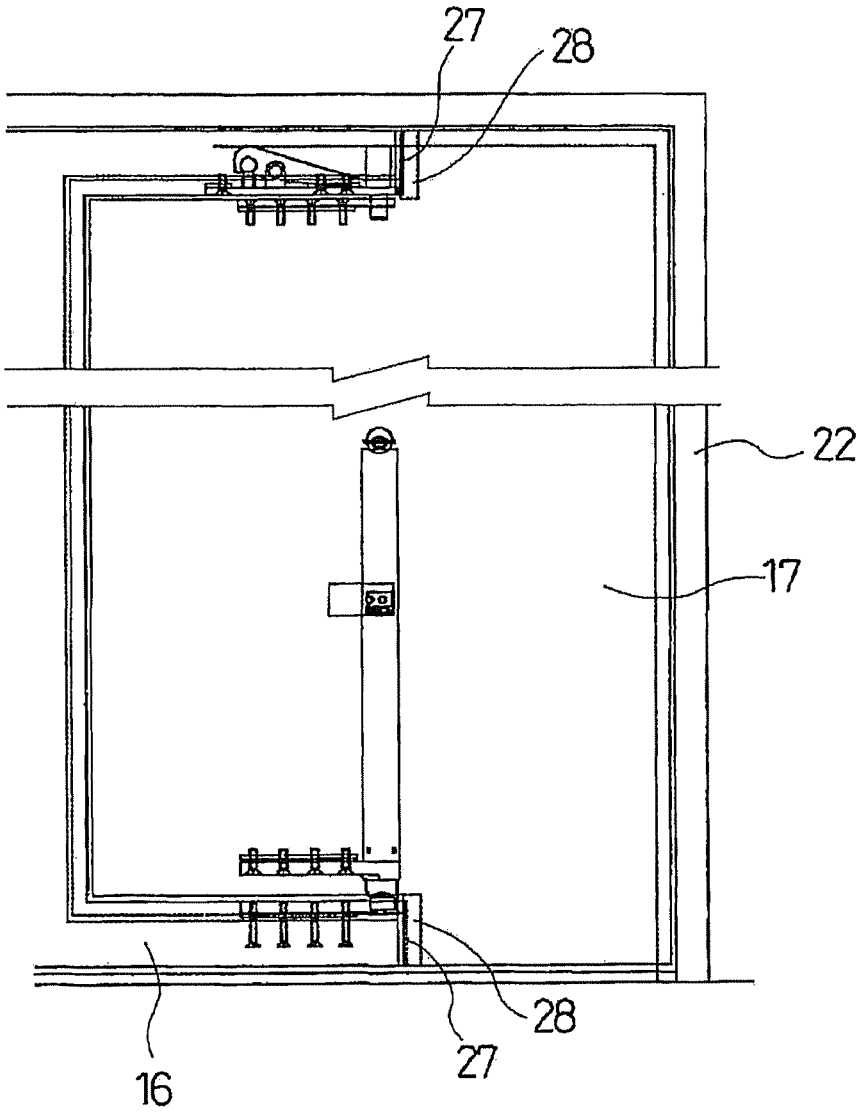
FIG. 7 is a front view illustrating a fourth embodiment of the door device with a pressure difference mitigating mechanism of the present invention.
Figure 8:
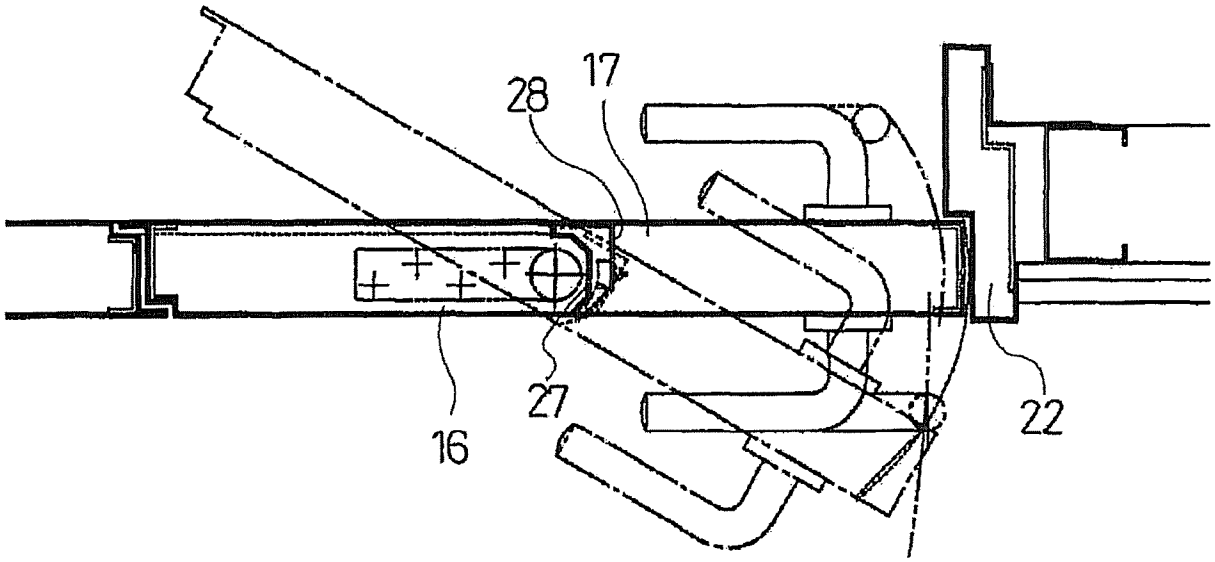
FIG. 8 is a plan view illustrating the fourth embodiment of the door device with a pressure difference mitigating mechanism of the present invention.

Moreover, as a fourth embodiment, corners of ends 27 of the portions constituting the upper and lower bearing portions 24*a* and 24*b* of the hanging door 16 in upper and lower rotating portions of the door are rounded to be chamfered as illustrated in FIGS. 7 and 8. In correspondence with that, the door-end door 17 side is recessed, and a covering 28 is provided.

By configuring as above, if ends of the portions constituting the upper and lower bearing portions are perpendicular, the one side of the hanging door 16 can be looked through in the upper and lower rotating portions of the door-end door 17, but by rounding the corners on the hanging door 16 side, by recessing the door-end door 17 side and by providing the covering 28, a state that the other side cannot be looked through can be ensured, and a condition to be approved as a fire door can be satisfied.

Figure 9:
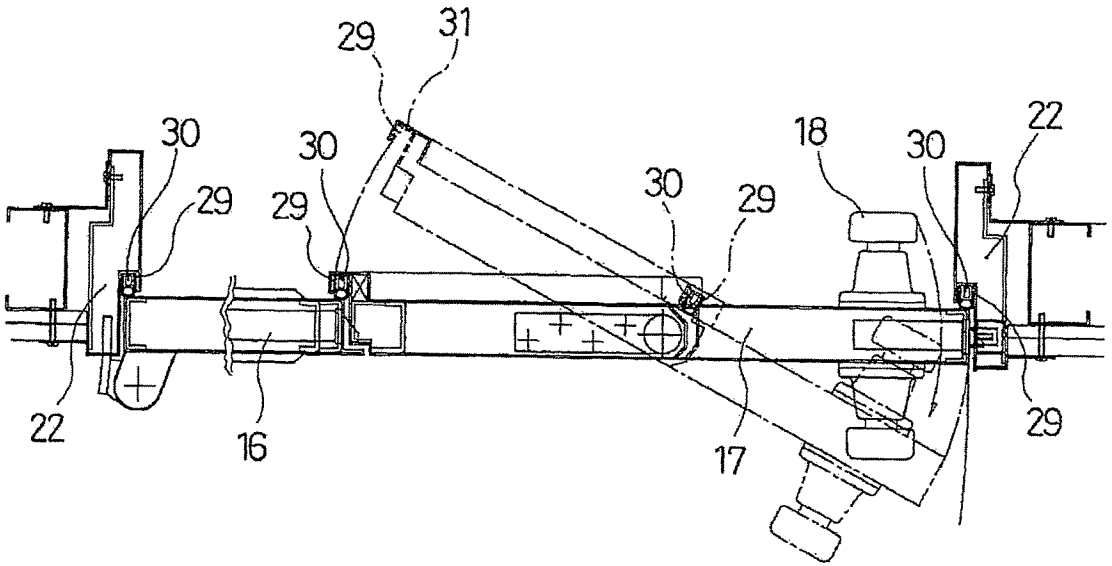
FIG. 9 is a plan view illustrating a fifth embodiment of the door device with a pressure difference mitigating mechanism of the present invention.
Figure 10:
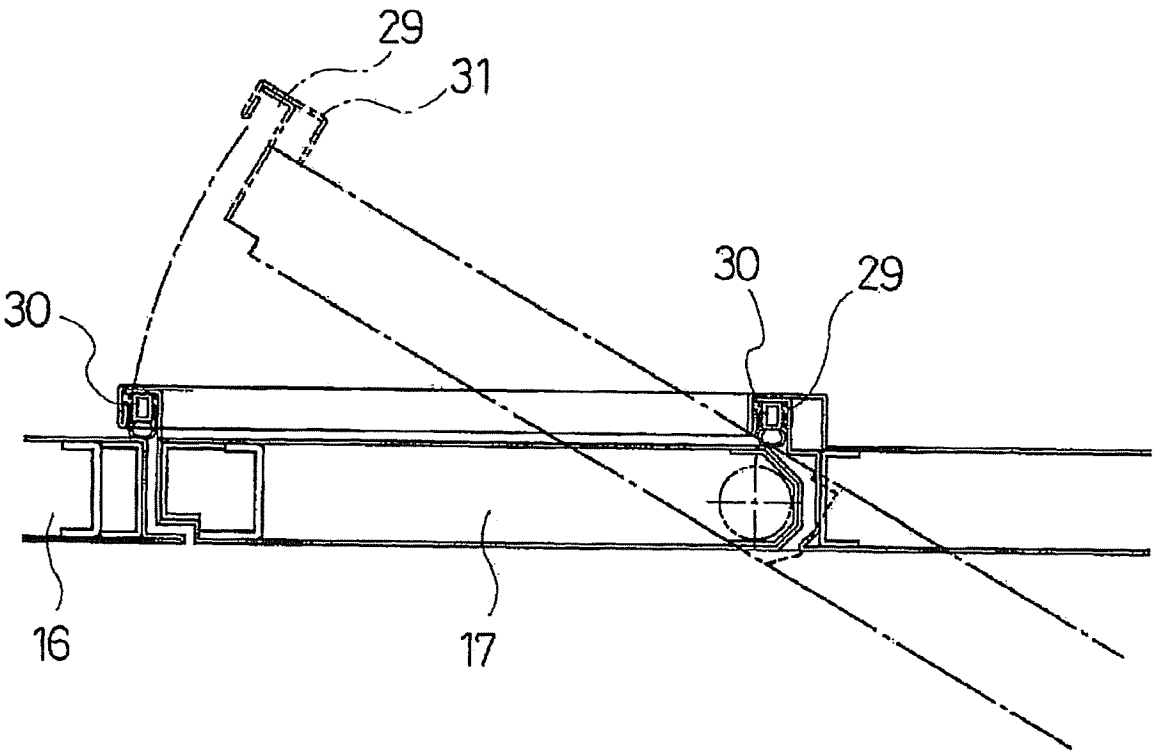
FIG. 10 is a plan view of an essential part illustrating the fifth embodiment of the door device with a pressure difference mitigating mechanism of the present invention.
Figure 11:
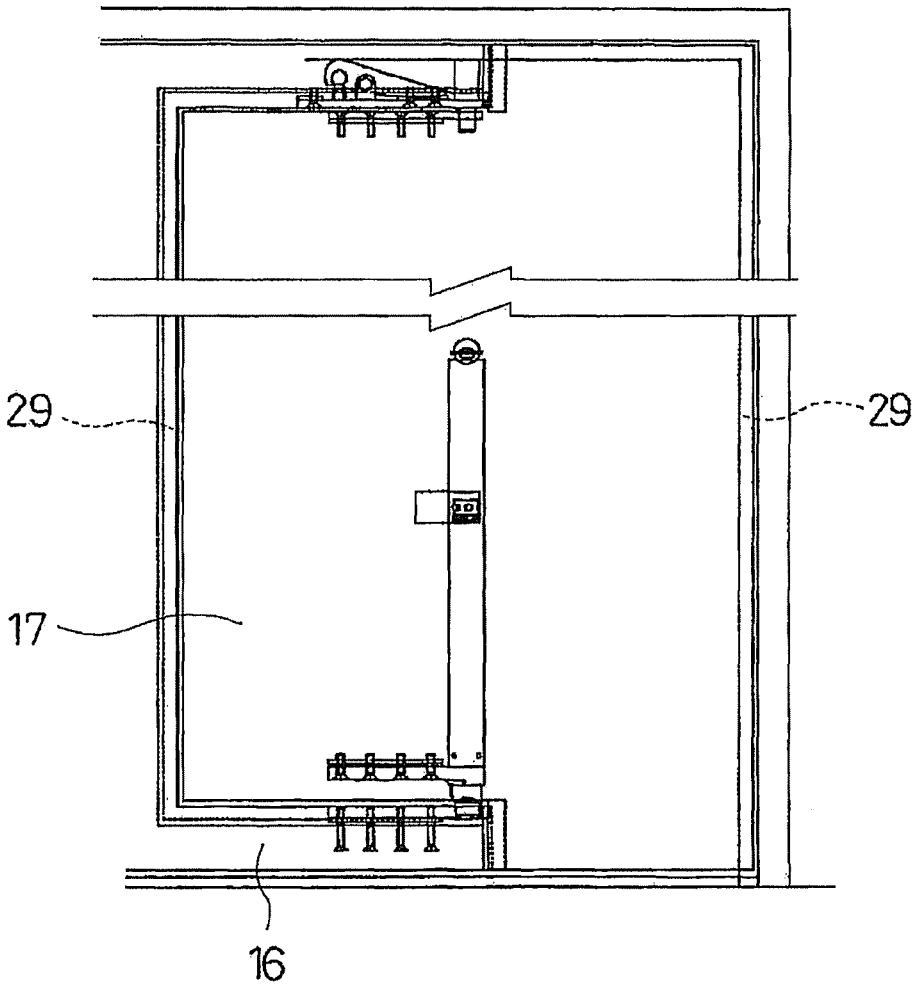
FIG. 11 is a front view illustrating the fifth embodiment of the door device with a pressure difference mitigating mechanism of the present invention.

Furthermore, as a fifth embodiment, as illustrated in FIGS. 9, 10, and 11, a dent 29 is provided on the door frame 22 side, and an airtight rubber 30 which is a rubber seal packing is disposed thereon so as to form that with a semi-airtight specification and to prevent air from going back and forth. An SAT rubber is used for the airtight rubber 30. Since the airtight rubber 30 is soft and easily collapsed by being pressed by an air pressure, hard rubber (not shown) is attached on the door frame 22 side in order to keep the hanging door 16 and the door-end door 17 straight even if they are pressed by the air pressure and to obtain favorable tightness.

Moreover, a door stop piece 31 is extended so as to cover a gap between the hanging door 16 and the door-end door 17 from the hanging door 16 and/or the door-end door 17.

By extending the door stop piece 31 as above, reverse rotation of the door-end door 17 can be prevented. Moreover, by covering the gap, looking through the gap from behind the door can be made difficult.

The dent 29 is provided also in the door stop piece 31, and the airtight rubber 30 is disposed therein so as to make also the relationship between the hanging door 16 and the door-end door 17 the semi-airtight specification. As a result, drop of airtightness caused by the split constitution of the door can be suppressed.

A portion in the door-end door 17 on the door tail side from the hinge is not overlapped with the upper and lower parts of the door frame 22 in a vertical direction so that rotation of the door-end door 17 to a door opening direction side with respect to the hanging door 16 is not limited by the door frame 22. As a result, the door-end door 17 can be opened first when the pressure difference is generated.

Subsequently, an instance in which the handle for opening/closing the door, the door closer, the latch A of the door-end door to the door frame, and the latch B of the door-end door to the hanging door are provided but the hinge closer is not provided will be explained.

In this case, the door is divided into two parts to left and right, that is, the hanging door and the door-end door pivotally supported by the hanging door;

the handle for opening/closing the door, the door closer, the latch A of the door-end door to a door frame, and the latch B of the door-end door to the hanging door are provided; and the relationship of the following:

a door opening force required against a door closing force of the door closer (handle position): $D_H$ a door closing force required against a door opening force of the door closer (handle position): $D_{HC}$ a force required against a releasing force of the latch B (handle position): $LB_H$ a load acting on the entire door by an air pressure difference (acting in a closing direction) (handle position): $PA_H$ and a load acting on the door-end door by the air pressure difference (acting in the closing direction) (handle position): $PB_H$, is set as follows:

$D_H < LB_H$ (the door-end door is not rotated, and the coupled door is opened in the normal time)

$D_S > LA_S$ (the latch A is pushed in by the closing force of the door closer)

$PA_H + D_{HC} > PB_H + LB_H$ (door-end door is opened at pressure difference).

Since the door opening force required against a door closing force of the door closer (handle position): $D_H$ is smaller than the force required against a releasing force of the latch B (handle position): $LB_H$, the hanging door and the door-end door can be integrally opened by applying the required door opening force against the door closing force of the hinge closer in the normal time.

Moreover, since the door closing force of the door closer (latch A position): $D_S$ is larger than the input load $LA_S$ of the latch A, the door can be self-closed in the normal time.

Moreover, since a sum of the load acting on the entire door by an air pressure difference (assumed to act in a closing direction) (handle position): $PA_H$ and the door opening force required against a door closing force of the door closer (handle position): $D_H$ is larger than a sum of the load acting on the door-end door by the air pressure difference (acting in the closing direction) (handle position): $PB_H$ and the door opening force required against a releasing force of the latch B (handle position): $LB_H$, only the door-end door can be opened first when the pressure difference is generated.

If the hinge closer is omitted, the rotation angle is preferably limited so that the door-end door 17 is not rotated by approximately 90 degrees or more with respect to the hanging door 16 in order to prevent closing nonconformity.

On the other hand, in an instance in which the handle for opening/closing the door, the hinge closer supporting/rotating the door-end door with respect to the hanging door and having a pressure in a closing direction, the latch A of the door-end door to the door frame, and the latch B of the door-end door to the hanging door are provided but the door closer is not provided, the following configuration is employed.

The door is divided into two parts to left and right, that is, the hanging door and the door-end door pivotally supported by the hanging door;

the handle for opening/closing the door, the hinge closer supporting/rotating the door-end door with respect to the hanging door and having a pressure in a closing direction, the latch A of the door-end door to a door frame, and the latch B of the door-end door to the hanging door are provided; and the relationship of the following:

a door opening force required against a door closing force of the hinge closer (handle position): $A_H$ a force required against a releasing force of the latch B (handle position): $LB_H$ a load acting on the entire door by an air pressure difference (acting in a closing direction) (handle position): $PA_H$ and a load acting on the door-end door by the air pressure difference (acting in the closing direction) (handle position): $PB_H$ is set as follows:

$PA_H+D_{HC}>PB_H+LB_H+A_H$ (door-end door is opened at pressure difference)

$A_{ST}>LB_{ST}$ (so that the door-end door returns to an integral opening/closing state with the hanging door).

Since the load acting on the entire door by an air pressure difference (assumed to act in a closing direction) (handle position): $PA_H$ is larger than a sum of the load acting on the door-end door by the air pressure difference (acting in the closing direction) (handle position): $PB_H$, the door opening force required against a releasing force of the latch B (handle position): $LB_H$, and the door opening force required against a door closing force of the hinge closer (handle position): $A_H$, only the door-end door can be opened first when the pressure difference is generated.

Moreover, since the door closing force (torque) $A_{ST}$ of the hinge closer is larger than the rotation resistance (torque) of the door-end door by an input load of the latch B: $LB_{ST}$, the door-end door can return to the integral opening/closing state with the hanging door.

On the other hand, the instance in which the door is divided into two parts to left and right, that is, the hanging door and the door-end door pivotally supported by the hanging door, and the handle for opening/closing the door, the latch A of the door-end door to the door frame, and the latch B of the door-end door to the hanging door are provided but the door closer and the hinge closer for rotating the door-end door to the hanging door are not provided will be as follows.

The door is divided into two parts to left and right, that is, the hanging door and the door-end door pivotally supported by the hanging door; and the handle for opening/closing the door, the latch A of the door-end door to the door frame, and the latch B of the door-end door to the hanging door are provided, and the relationship of the following:

a force required against a releasing force of the latch B (handle position): $LB_H$ a load acting on the entire door by an air pressure difference (acting in a closing direction) (handle position): $PA_H$ and a load acting on the door-end door by the air pressure difference (acting in the closing direction) (handle position): $PB_H$ is set as follows:

$PA_H>PB_H+LB_H$ (the door-end door is opened when the pressure difference is generated).

Since the load acting on the entire door by an air pressure difference (assumed to act in a closing direction) (handle position): $PA_H$ is larger than a sum of the load acting on the door-end door by the air pressure difference (acting in the closing direction) (handle position): $PB_H$ and the door opening force required against a releasing force of the latch B (handle position): $LB_H$, only the door-end door can be opened first when the pressure difference is generated.

If the latch A is omitted, the following relational equation is not necessary:

$D_S>LA_S$ (the latch A is pushed in by the closing force of the door closer)

$A_{ST}+PB_{ST}>LA_{ST}+LB_{ST}$ (door-end door is closed with the entire door at pressure difference)

$A_{ST}+PB_{ST}>LA_{ST}$ (door-end door itself is closed).

In the above embodiments, the fire door with a pressure difference mitigating mechanism of the present invention is installed in a passage of a fire control area is explained, but the present invention can be applied not only to such fire doors but also instances with an air pressure difference such as an entrance of a machine room and the like.

Moreover, the door can be applied to a door of a building with a concern of inundation. In the normal time, a door is opened/closed as a door with a door closer in which two doors are integrally operated, while if the building submerges in water due to tsunami, flood or the like, and a water pressure difference is generated between an inside and an outside of a room to such a degree that the integral single-panel door cannot be opened easily, the door-end door 17 can be opened first, whereby the water pressure can be solved, and the door 15 can be opened easily for evacuation.

In this case, in the above relational equations, $PA_R$ reads a load acting on the entire door by a water pressure difference (acting in a closing direction) (handle position), and $PB_H$ reads a load acting on the door-end door by a water pressure difference (acting in a closing direction) (handle position).

The invention claimed is:

1. A door device with pressure difference mitigating mechanism, comprising:

a door divided into a hanging door portion and a door-end door portion pivotally supported by the hanging door portion;

a handle for opening and closing the door;

a door closer;

a hinge closer for supporting and rotating the door-end door portion with respect to the hanging door portion and having a pressure in a closing direction, a first latch for latching the door-end door portion to a door frame; and a second latch for latching a left side of the door-end door portion to a right side of the hanging door portion, wherein relationships $D_H<A_H+LB_H$ $PA_H+D_{HC}>PB_H+A_H+LB_H$ are satisfied in which $D_H$ is a door opening force at a handle position required to overcome a door closing force of the door closer, $D_{HC}$ is the door closing force at the handle position required to overcome the door opening force of the door closer, $A_H$ is the door opening force at the handle position required to overcome the door closing force of the hinge closer, $LB_H$ is a force at the handle position required to overcome a releasing force of the latch B, $PA_H$ is a load acting in the closing direction on the door at the handle position by a pressure difference, and $PB_H$ is a load acting in the closing direction on the door-end door portion at the handle position by the pressure difference, and wherein one side of the hanging door portion defines a notched opening and upper and lower bearing portions, a stepped contracted portion of the door-end door portion is fitted in the notched opening and the door-end door portion is pivotally supported by the hinge closer, and a rotating shaft of the door-end door portion pivotally supported by the hanging door portion is not made eccentric but is set at a center of the door-end door portion, and the second latch is a roller catch or a magnet catch.

2. The door device with pressure difference mitigating mechanism according to claim 1, wherein relationships $$D_S > LA_S,$$

$$A_{ST} + PB_{ST} > LA_{ST} + LB_{ST},$$

$$A_{ST} + PB_{ST} > LA_{ST} \text{ and}$$

$$A_{ST} + PB_{ST} > LB_{ST}$$

are satisfied in which $D_S$ is a door closing force at a first latch position of the door closer, $LA_S$ is an input load of the first latch, $A_{ST}$ is a door closing force of the hinge hinge closer, $PB_{ST}$ is a rotating force acting on the door-end door portion by an air pressure difference, $LA_{ST}$ is a rotation resistance of the door-end door portion by an input load of the first latch, and $LB_{ST}$ is a rotation resistance of the door-end door portion by an input load of the second latch.

3. The door device with pressure difference mitigating mechanism according to claim 1, wherein a height of about a half of the door-end door portion is the same as the height of the hanging door portion.

4. The door device with pressure difference mitigating mechanism according to claim 1, wherein a door stop piece is extended so as to cover a gap between the hanging door and the door-end door from the hanging door and/or the door-end door.

5. The door device with pressure difference mitigating mechanism according to claim 4, wherein an airtight rubber is attached to the door stop piece.

6. The door device with pressure difference mitigating mechanism according to claim 5, wherein a dent is provided on the door frame side, and the airtight rubber is disposed therein so as to form the door with a semi-airtight specification.

7. The door device with pressure difference mitigating mechanism according to claim 6, wherein corners of upper and lower rotating portions on the hanging door side are rounded, and the door-end door side is recessed so as to provide a covering.

* * * * *